US007062935B2

(12) United States Patent
Siefker

(10) Patent No.: US 7,062,935 B2
(45) Date of Patent: Jun. 20, 2006

(54) PERFORATED ICE BIN INSERT

(75) Inventor: Joseph D. Siefker, Grafton, OH (US)

(73) Assignee: Cold Core, Ltd., Grafton, OH (US)

( * ) Notice: Subject to any disclaimer, the term of this patent is extended or adjusted under 35 U.S.C. 154(b) by 0 days.

(21) Appl. No.: 10/890,535

(22) Filed: Jul. 13, 2004

(65) Prior Publication Data

US 2004/0244399 A1 Dec. 9, 2004

Related U.S. Application Data

(63) Continuation of application No. 10/401,298, filed on Mar. 27, 2003, now Pat. No. 6,763,674.

(60) Provisional application No. 60/368,194, filed on Mar. 27, 2002.

(51) Int. Cl.
*F25C 5/18* (2006.01)

(52) U.S. Cl. ..... 62/344; 62/390

(58) Field of Classification Search ..... 62/344, 62/389, 390

See application file for complete search history.

(56) References Cited

U.S. PATENT DOCUMENTS 4,679,715 A * 7/1987 Hovinga ..... 222/517
5,090,214 A * 2/1992 LoGioco ..... 62/457.7

FOREIGN PATENT DOCUMENTS

JP 404196332 A * 8/1993 ..... 62/344

* cited by examiner

*Primary Examiner*—William E. Tapolcai
(74) *Attorney, Agent, or Firm*—Fay, Sharpe, Fagan, Minnich & McKee, LLP

(57) ABSTRACT

An ice bin insert (10) separates a single store of ice pieces into separate stashes, namely, into potable and non-potable portions. The insert (10) includes a divider (C, D) dimension to be received within an ice holding cavity of an ice bin (30). Support members (B, E) attached to the divider (C, D) hold the divider (C, D) at a desired position within the ice holding cavity of the ice bin (30). A plurality of perforations (12) are arranged within the divider (C, D) so as to permits ice pieces to flow from a first side thereof to a second side thereof while inhibiting retrieval of ice pieces on the second side from the first side. Preferably, the insert (10) is constructed from a unitary sheet of stainless steel which is bent to define the respective portions or sections thereof.

11 Claims, 3 Drawing Sheets

PERFORATED ICE BIN INSERT

This application is a continuation of U.S. application Ser. No. 10/401,298, filed Mar. 27, 2003 now U.S. Pat. No. 6,763,674, which claims the benefit of U.S. Provisional Application No. 60/368,194, filed Mar. 27, 2002, both of which are incorporated herein by reference in their entirety.

FIELD

The present invention relates to beverage cooling arts. It finds particular application in conjunction with commercial-type open system ice bins and open system loose auxiliary beverage cooling plates or like devices, and will be described with particular reference thereto. However, it is to be appreciated that the present invention is also amenable to other like applications.

BACKGROUND

Commercially, some vendors employ open ice bin systems for the cooling of beverages (i.e., soft drinks and the like). Often, beverage cooling in such an environment is accomplished by placing a separate loose auxiliary cooling device in an open ice bin and covering it with otherwise potable ice. This can result in the contamination of the potable ice from contact with the auxiliary cooling device and its supporting connections. Consequently, the otherwise potable ice may be changed into "non-potable ice" in accordance with some health codes and deemed not fit for human consumption. This can be disadvantageous insomuch as commercial beverage vendors would like to manually serve ice to their customers out of the same open ice bin. In other words, the current practice of placing the separate loose auxiliary cooling device inside an open ice bin with sufficient ice storage capacity to provide cooling to the auxiliary cooling device and storage for potable ice can be disadvantageous to the extent that it renders the otherwise potable ice unfit for human consumption because ice in direct contact with the auxiliary cooling device and/or supporting connections is considered contaminated by some health code standards.

One option is to have separate distinct open ice bins for the potable ice and the auxiliary cooling device. This is often times inefficient and burdensome on the vendor insomuch as it would mean that the vendor is purchasing and/or maintaining separate dedicated pieces of equipment, presuming space for the same is even available.

Smaller ice pans are sometimes filled with the potable ice and placed in the open ice bin. The customers are served ice out of this smaller ice pan. The rest of the open ice bin, containing the auxiliary cooling device, can then be filled with non-potable ice. This technique essentially divides the ice bin into two distinct ice storage areas, i.e., inside the pan and outside the pan. Accordingly, the potable ice inside the pan remains separate and distinct from the non-potable ice outside the pan, which is in direct contact with the auxiliary cooling device. However, oftentimes, the space restraints of the ice bin do not allow the smaller ice pans to be inserted therein. Further, even if the smaller ice pan does fit, the vendor is still burdened with having to maintain two distinct stores of ice with reduced capacity, which in turn is burdensome to the vendor.

Another solution is to use a cooling device which is sealed from or otherwise outside the ice receiving cavity of the ice bin. However, such a solution does not easily or readily retrofit with respect to existing equipment or open ice bins.

Accordingly, use of sealed cooling devices commonly involves the purchase of all new equipment, which can be financially burdensome and foregoes the opportunity to take advantage of existing open system equipment. Sealed cooling devices also tend to be more difficult to service insomuch as they are sealed and often integrated with the ice bin, hence they are typically less accessible than separate loose auxiliary cooling devices. For example, such an ice bin unit with the cooling device sealed in below the surface of the interior ice storage cavity can be costly, and the auxiliary cooling devices may not be readily accessible for cleaning, inspection and/or servicing purposes.

The present invention contemplates a new and improved perforated ice bin insert, which maintains a manual, open system operation utilizing existing open system equipment and overcomes the above-referenced problems and others.

SUMMARY

In accordance with one aspect of the present invention, an ice bin insert is provided for a manual service open ice bin having an ice holding cavity. The insert separates a single store of ice pieces into separate stashes and includes a divider dimension to be received within the ice holding cavity of the ice bin, and support members attached to the divider. The support members hold the divider at a desired position within the ice holding cavity of the ice bin. A plurality of perforations are formed in the divider. The perforations are arranged such that the divider permits ice pieces to flow from a first side thereof to a second side thereof while inhibiting retrieval of ice pieces on the second side from the first side.

In accordance with a more limited aspect of the present invention, the divider and said support members are formed from a substantially rigid material, the support members including at least one wall having a shape which substantially conforms to a contour of an ice bin wall that defines the ice holding cavity of the ice bin.

In accordance with a more limited aspect of the present invention, the divider and support members are formed from a substantially planar unitary sheet of material having a plurality of bends therein which define the divider and support members.

In accordance with a more limited aspect of the present invention, the divider includes a substantially planar first section.

In accordance with a more limited aspect of the present invention, the support members are arranged to hold the divider at a height above a floor of the ice holding cavity of the ice bin. The height is sufficient to permit an auxiliary cooling device and a layer of ice pieces surrounding the same to be arranged between the divider and the floor of the ice holding cavity of the ice bin.

In accordance with a more limited aspect of the present invention, the support members are arranged to hold the first section substantially parallel to the floor of the ice holding cavity of the ice bin.

In accordance with a more limited aspect of the present invention, the divider includes a substantially planar second section arranged between the first section and at least one of the support members, the second section being sloped relative to the first section.

In accordance with a more limited aspect of the present invention, the support members includes substantially planar first and second walls connected to the divider, each of the first and second walls being connected to respective opposing ends of the divider.

In accordance with a more limited aspect of the present invention, the walls are substantially normal to the first section of the divider.

In accordance with a more limited aspect of the present invention, the walls do not permit ice pieces to flow therethrough.

In accordance with a more limited aspect of the present invention, the ice bin insert further includes a channel formed at an end of the first wall opposite the divider. The channel is arranged to receive therein a lip of the ice bin, the lip defining at least a portion of an opening for the ice holding cavity of the ice bin.

In accordance with a more limited aspect of the present invention, the ice bin insert further includes a substantially planar connecting plate formed at an end of the second wall opposite the divider, the connecting plate being arranged for engagement with at least a portion of the ice bin so that the insert is supported therefrom.

In accordance with a more limited aspect of the present invention, the connecting plate is substantially normal to the second wall and arranged so as to rest upon a portion of the ice bin.

In accordance with a more limited aspect of the present invention, the connecting plate includes at least one opening therein for passing through connections to an auxiliary cooling device situated under the insert in the ice holding cavity of the ice bin.

In accordance with a more limited aspect of the present invention, the connecting plate includes holes therein through which fasteners pass to fasten the insert to the ice bin.

In accordance with another aspect of the present invention, an insert for an ice bin includes a vertically extending first wall, the first wall being solid and having opposing first and second ends; a vertically extending second wall, the second wall being solid and having opposing first and second ends; and, a horizontally extending perforated first plate connected between the first ends of the first and second walls. The insert is arranged so as to permit ice pieces to migrate through the first plate and restrict access to ice pieces once they have migrated through the first plate.

In accordance with a more limited aspect of the present invention, the insert includes a perforated second plate connected between the first plate and the second wall, the second plate being sloped with respect to the first plate and permitting ice pieces to migrate therethrough.

In accordance with a more limited aspect of the present invention, the insert includes a channel formed at the second end of the first wall, the channel arranged to receive at least a portion of a lip of an ice bin such that the insert is supported thereon.

In accordance with a more limited aspect of the present invention, the insert includes a connection plate formed at the second end of the second wall, the connection plate arranged to engage with at least a portion of an ice bin such that the insert is supported thereby.

In accordance with a more limited aspect of the present invention, the first and second walls and the first and second plates are formed from a unitary sheet of stainless steel.

In accordance with a more limited aspect of the present invention, a portion of the insert rests upon a portion of the ice bin without being attached thereto such that the insert is supported by the ice bin and selectively removable from and installable in the ice bin, the first plate being positioned inside an ice holding cavity of the ice bin above a floor of the ice holding cavity when the insert is installed in the ice bin.

In accordance with yet another aspect of the present invention, a beverage cooling system includes: an ice bin having an ice holding cavity including a floor and one or more walls defining the cavity and an opening through which ice pieces are selective loaded into and removed from the cavity; a loose auxiliary cooling device separate from the ice bin and placed on the floor inside the cavity of the ice bin; one or more supporting connections operatively connected with the cooling device to circulate a beverage to be cooled through the cooling device; a divider arranged within the ice holding cavity of the ice bin; support members attached to the divider, the support members holding the divider at a desired position above the cooling device within the ice holding cavity of the ice bin; and, a plurality of perforations within the divider, the perforations being arranged such that the divider permits ice pieces to flow from a top side of the divider to a bottom side of the divider while inhibiting retrieval of ice pieces on the bottom side from the top side.

In accordance with a more limited aspect of the present invention, the divider and support members comprise an insert which is selectively removable from the ice bin.

In accordance with a more limited aspect of the present invention, the insert includes cutouts through which the supporting connections are routed when the insert is installed in the ice bin.

In accordance with a more limited aspect of the present invention, the insert extends through the opening of the ice bin when installed therein.

One advantage of the present invention is that it optionally provides the ability to segregate a single store of ice into potable and non-potable portions.

Another advantage of the present invention is that it optionally provides the ability to use a single ice bin unit for both the cooling of auxiliary cooling devices and the storage of ice for consumption.

Yet another advantage of the present invention is that it optionally provides an economically attractive retrofit for existing manual service open ice bin units.

Still further advantages and benefits of the present invention will become apparent to those of ordinary skill in the art upon reading and understanding the following detailed description of the preferred embodiments.

BRIEF DESCRIPTION OF THE DRAWINGS

The invention may take form in various components and arrangements of components, and in various steps and arrangements of steps. The drawings are only for purposes of illustrating preferred embodiments and are not to be construed as limiting the invention. Further, it is to be appreciated that the drawings are not to scale.

DETAILED DESCRIPTION OF PREFERRED EMBODIMENTS

Figure 1:
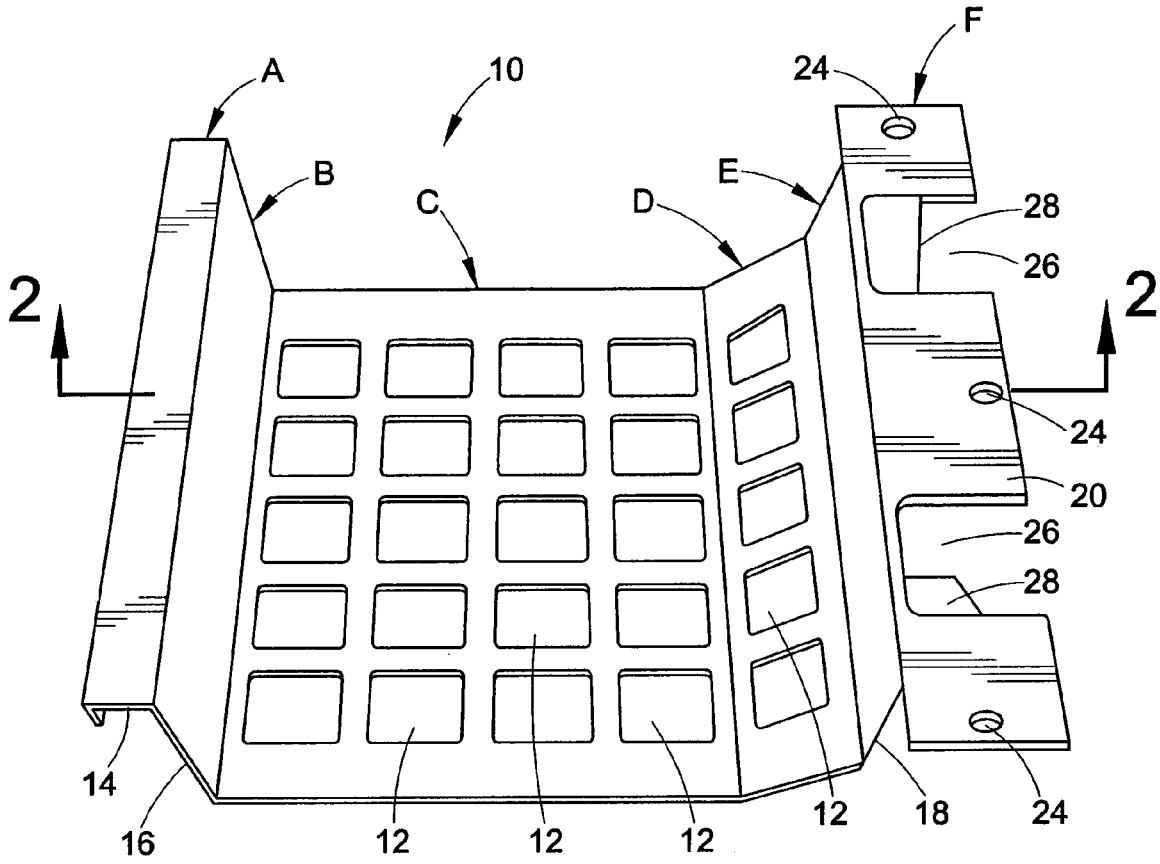
FIG. 1 is a diagrammatic illustration showing a perspective view of an exemplary embodiment of a perforated ice bin insert in accordance with aspects of the present invention.
Figure 2:
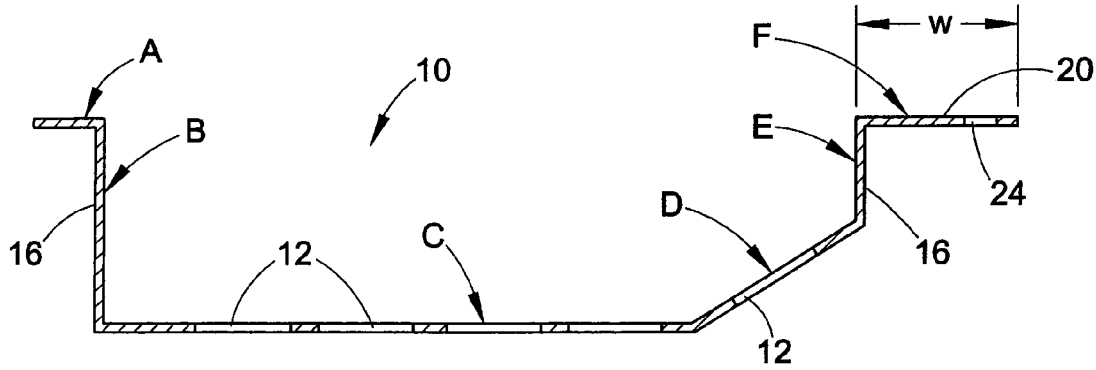
FIG. 2 is a diagrammatic illustration showing a sectional view of the ice bin insert of FIG. 1 taken along section line 2—2.

With reference to FIGS. 1 and 2, an exemplary embodiment of a perforated ice bin insert 10 in accordance with aspects of the present invention is preferably made out of 304 stainless steel. However, other suitable materials may be used, e.g., other suitable materials preferably are substantially rigid, durable, corrosion resistant and/or non-porous materials which meet or exceed health and safety code specifications for the food and beverage service/preparation industries. In a preferred embodiment, the insert 10 meets or exceeds the National Sanitation Foundation (NSF) guidelines and/or American National Standards Institute (ANSI) standards for the food and beverage service/preparation industries. The insert 10 is preferably of one-piece construction, i.e., a single sheet or plate of material formed with or otherwise made to have multiple perforations 12 and bends. The insert 10 may be dimensioned as desired to fit into various sizes of open ice bins. That is to say, the insert's length, width and/or depth may vary so as to closely match interior dimensions of various manual service open ice bins, i.e., ice bins of the type where a vendor exercises direct access to the ice therein for manual serving of the same.

Figure 3:
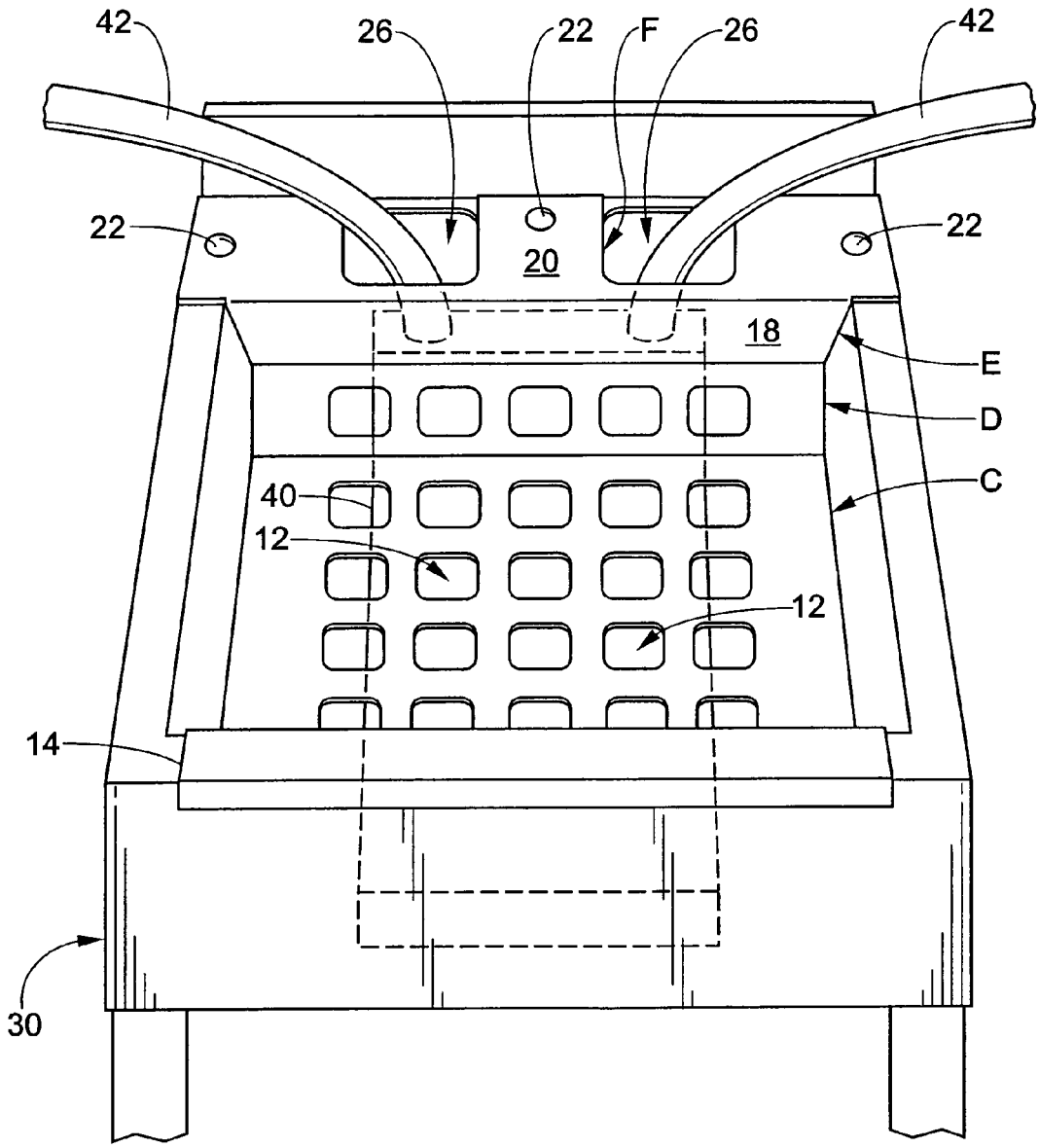
FIG. 3 is a diagrammatic illustration showing the perforated ice bin insert of FIG. 1 in an exemplary use in an open ice bin.

Preferably, when installed in an ice bin, such as the manual service open ice bin unit 30 as shown in FIG. 3, at least a portion of a periphery of the insert 10 is attached to and/or rests upon at least a portion of a periphery of the ice bin opening. Alternately, the insert 10 may otherwise be supported in and/or attached to the ice bin 30. For example, the insert 10 may rest on the bottom floor of the ice bin's storage area, and include legs or other supports that raise the perforated section of the insert 10 above the same.

Referring again to FIGS. 1 and 2, via the aforementioned bends or otherwise, the insert 10 is preferably formed so that it extends through the opening into an ice storage or holding cavity of the manual service open ice bin unit 30. In the illustrated embodiment, the insert 10 possesses six primary sections defined by the aforementioned bends. The sections include: a front mounting section A, a front wall section B, first and second floor sections C and D, a rear wall section E, and a rear mounting section F.

As shown, the front mounting section A includes an inverted j-channel 14 arranged to conform to and receive a front lip of the ice bin unit 30 when installed therein (see FIG. 3). The inverted j-channel 14 is designed to secure the front section A of the insert 10 to the front of the ice bin unit 30. The inverted j-channel 14 is preferably sized to fit over the upper lip of the front of the ice bin unit 30. Accordingly, when installed, the insert 10 firmly rests within the ice storage cavity of the unit 30 with the front section A being supported on and/or by the front lip of the unit 30. Further, the j-channel 14 allows the front mounting section A to rest securely on the front lip of the unit 30 without having to be physically attached thereto, therefore, the insert 10 can be easily removed for servicing the ice bin unit 30, completing repairs to the ice bin unit 30, servicing a separate loose auxiliary cooling device 40, clearing the unit's drain (not shown), maintaining support connections 42, etc. Alternately, however, the front section A may be attached to the unit 30 with fasteners. The fasteners may be permanent or selectively removable and are preferably mechanical fasteners (e.g., screws, nuts and bolts, rivets, etc.), but they may be otherwise (e.g., an adhesive, welds, etc.). While either may be used, it is to be appreciated that removable fasteners (as compared to permanent ones) provide for easier detachment of the insert 10 from the unit 30 as desired, e.g., for cleaning, servicing, maintenance, etc. of the insert 10, the unit 30, the auxiliary cooling device 40, support connections 42 or other components. In any event, it is to be appreciated that the front mounting section A may take various optional configurations for support and mounting purposes.

The front wall section B is preferably a substantially vertical wall 16 which follows the contour of the front of the ice bin unit 30. The vertical wall 16 has 90-degree bends at either end with a bottom end connected to the first floor section C and an opposing top end connected to the front mounting section A. The front wall section B is preferably rigid and provides added strength to the insert 10 so that it does not sag when ice is piled onto the same. The front wall section B is preferably solid and without perforations and is designed to maximize potable ice storage capacity. Similarly, the rear wall section E is also preferably a substantially vertical wall 18 which follows the contour of the rear of the ice bin unit 30. The vertical wall 18 has bends at either end with a bottom end connected to the second floor section D and an opposing top end connected to the rear mounting section F. The rear wall section E is preferably rigid and provides added strength to the insert 10 so that it does not sag when ice is piled onto the same. The rear wall section E is preferably solid and without perforations and is designed to maximize potable ice storage capacity. Together, the lengths of the vertical walls 16 and 18 determine how far into the ice storage cavity the insert 10 extends. Preferably, these lengths are chosen so that the insert 10 extends into the cavity as much as possible while still leaving room below or otherwise outside the insert 10 for both: (i) the auxiliary cooling device 40, and (ii) a layer of ice of a selected thickness around the cooling device 40. The space or gap between the floor of the cavity and the bottom of the insert 10 is suitably in the range of approximately 3 to 5 inches, and preferably, it is approximately 4 inches.

The rear mounting section F preferably includes a substantially horizontal surface 20 which is arranged to be attached to a rear lip of the ice bin unit 30 by removable fasteners, such as screws 22 (as shown in FIG. 3), extending through holes 24 (best seen in FIG. 1). In this manner, the insert 10 is securely attached to the unit 30. Alternately, to facilitate quick and easy removal of the insert 10, the horizontal surface 20 may simply rest upon the rear lip of the ice bin unit 30 without being attached thereto. Additionally, similar to the front mounting section A, other fasteners and/or fastening techniques including permanent or removable fasteners may be used, and the fasteners may be mechanical or otherwise. Furthermore, the rear mounting section F optionally rests upon and/or is attached to a rear backsplash of the unit 30 in addition to or in lieu of resting/attaching to the rear lip of the unit 30.

Optionally, rather than screws 22 extending through holes 24 to attach the insert 10 to the unit 30, guide pins having maximum outside dimensions less than the dimension of the holes 24 are arranged on or otherwise extend from a rear lip of the unit 30. When the insert 10 is installed in the unit 30, the guide pins mate with and extend through the holes 24. The holes 24 simply pass over the guide pins as the insert 10 is set into the unit 30. The guide pins ensure proper positioning of the insert 10 in the unit 30, and provide additional stabilization for the insert 10 by restricting its lateral movement in the plane horizontal to the rear mounting section F. Attachment with screws 22 or other fasteners can similarly achieves these results. Unlike the guide pins, attachment may also restrict vertical movement (i.e., lifting of the insert 10 out of the unit 30). Compared to attachment, however, the guide pins permit relatively quicker and easier removal of the insert 10 from the unit 30.

The width w of the horizontal surface 20 is preferably chosen so that the vertical wall 18 is spaced apart from the rear wall of the ice bin unit 30. Preferably, enough room is maintained to run the supporting connections 42 between the vertical wall 18 and the rear wall of the ice bin unit 30. That is to say, w is sized such that the space or gap between the rear wall of the ice bin unit 30 and the vertical wall 18 of the insert 10 is suitably in the range of approximately 1 to 3 inches, and preferably, it is approximately 2 inches.

The supporting connections 42 extend to and from the auxiliary cooling device 40 sitting in the ice storage cavity of the unit 30, e.g., as shown in FIG. 3. The connections 42 include the lines that circulate the beverages to be cooled by the device 40 to and from the same. The horizontal surface 20 preferably has openings or cutouts 26 therein to allow for the connections 42 to pass through the rear mounting section F of the insert 10, for example, as best seen in FIG. 3. Optionally, folded down dog ears or tabs 28 (as best seen in FIG. 1) aid in guiding the supporting connections 42 through the openings or cutouts 26.

The bottom sections C and D preferably include an array of perforations 12. In the exemplary embodiment shown, they are joined together at a 135-degree angle and joined at opposing ends to sections B and E, respectively, at a 90-degree angle and a 135-degree angle. This arrangement of angles is designed to maximize potable ice storage capacity and provide easy access to the potable ice for human consumption. That is to say, the slant of bottom section D urges potable ice to the front of the ice bin unit 30 where it is more easily accessible. In any event, it is to be appreciated that other arrangements and different angular orientations of bottom sections are contemplated, and further, more or less bottom sections may be included. For example, there may be a singular bottom section joined at 90-degree angles to both sections B and E, or the singular bottom section may be joined to sections B and E at selected angles so that it slopes down toward the front of the ice bin unit 30.

The perforations 12 are preferably arranged and/or sized to permit the migration of ice (e.g., cubes or other pieces, fragments or particles) across the insert 10, i.e., from inside the insert 10 to outside the insert 10. The perforations 12 preferably are large enough to allow a sufficient ice flow through the insert 10 while still being small enough to effectively obstruct manual access to or the retrieval of that ice which has passed through the insert 10. In one suitable embodiment, the perforations 12 are approximately 1.75 by 1.75 inch square cutouts or apertures with rounded corners. However, other sizes and/or shapes for the perforations 12 are contemplated depending on the size and/or shape of the ice pieces being employed.

In operation, the separate loose auxiliary cooling device 40 is first placed in the manual service open ice bin 30. The insert 10 is then installed with the supporting connections 42 to the cooling device 40 being threaded through the cutouts 26. Next, ice is loaded into the unit 30. Ice placed in the unit 30 with the installed insert 10 is free to pass through the insert 10 to surround and cool the cooling device 40, however, only the ice on the top or which otherwise does not pass through the insert may be readily accessed and manually retrieved for human consumption. Accordingly, the same store of ice is segregated into one stash of manually accessible potable ice inside the insert 10 (i.e., the ice that does not pass through the insert 10) and another stash of inaccessible non-potable ice outside the insert 10 (i.e., the ice that does pass through the insert 10 and is potentially contaminated by the cooling device 40 and/or its supporting connections 42). In this manner, the insert 10 provides segregation of the auxiliary cooling device 40 and its support connections 42 from the potable ice storage area inside the insert 10.

Figure 4:
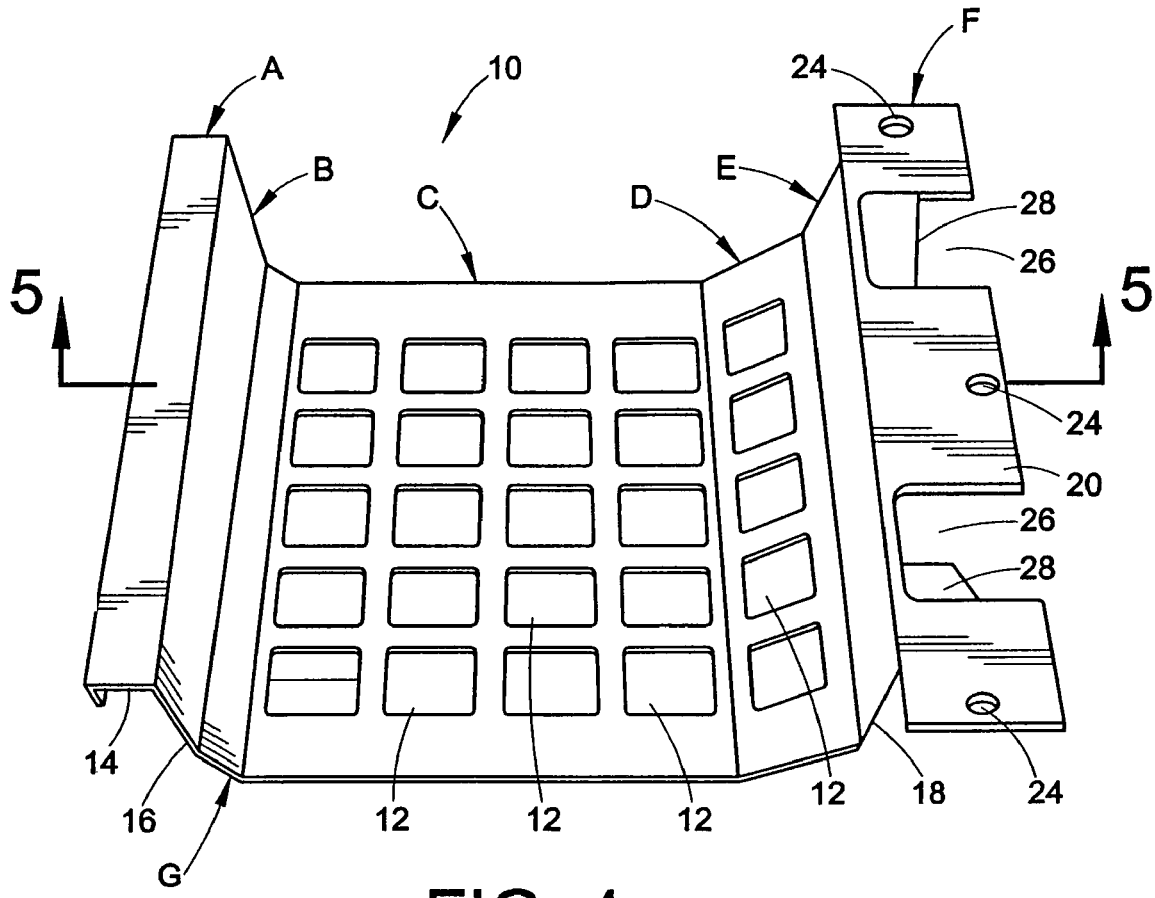
FIG. 4 is a diagrammatic illustration showing a perspective view of another exemplary embodiment of a perforated ice bin insert in accordance with aspects of the present invention.
Figure 5:
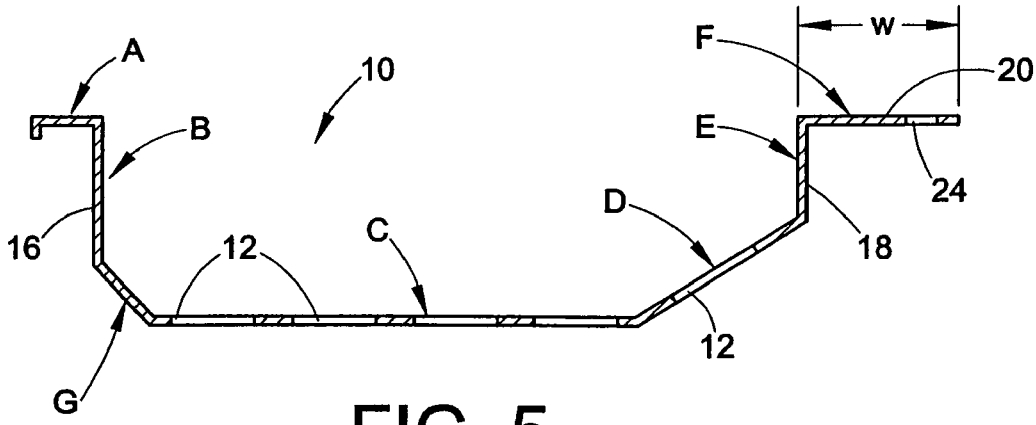
FIG. 5 is a diagrammatic illustration showing a sectional view of the ice bin insert of FIG. 4 taken along section line 5—5.

With reference to FIGS. 4 and 5, another exemplary embodiment of a perforated ice bin insert 10 has an additional section G including a wall interposed between sections B and C. As shown, the respective sections meet at 135-degree angles, and the wall of section G has no perforations 12 (although, it may optionally include them). As compared to the 90-degree angle shown in FIG. 1 between sections B and C, the larger angles at which the respective sections B, C and G meet one another permit greater access to and/or easier cleaning at the bends.

The invention has been described with reference to the preferred embodiment(s). Obviously, modifications and alterations will occur to others upon reading and understanding the preceding detailed description. It is intended that the invention be construed as including all such modifications and alterations insofar as they come within the scope of the appended claims or the equivalents thereof.

The invention claimed is:

1. An insert for arrangement in an ice holding cavity of an ice bin, said insert comprising:

a divider dimension to be received within the ice holding cavity of the ice bin, wherein the ice holding cavity includes a floor and one or more walls defining the cavity and an opening through which ice pieces are selective loaded into and removed from the cavity;

a plurality of perforations within the divider, said perforations being arranged such that the divider permits ice pieces to flow from a first side thereof to a second side thereof while inhibiting retrieval of ice pieces on the second side from the first side; and, support members attached to the divider, said support members holding the divider at a desired position within the ice holding cavity of the ice bin, wherein the divider is positioned such that an auxiliary cooling device separate from the ice bin can be placed on the floor inside the cavity of the ice bin on the second side of the divider;

wherein the insert includes cutouts through which one or more supporting connections pass to operatively connected with the cooling device for circulating a beverage to be cooled through the cooling device.

2. The insert of claim 1, wherein said divider includes a substantially planar first section.

3. The insert of claim 2, wherein said support members includes substantially planar first and second walls connected to the divider, each of the first and second walls being connected to respective opposing ends of the divider.

4. The insert of claim 1, wherein the insert extends through the defined opening.

5. The insert of claim 4, wherein the insert is selectively removable from the ice bin.

6. The insert of claim 1, wherein said divider includes a first section and a second section, said second section arranged at an angle relative to the first section, said angle being greater than 90 degrees and less than 180 degrees.

7. The insert of claim 6, wherein the first section and the second section are each substantially planar.

8. A beverage cooling system comprising:

an ice bin having an ice holding cavity including a floor and one or more walls defining the cavity and an opening through which ice pieces are selective loaded into and removed from the cavity;

a loose auxiliary cooling device separate from the ice bin and placed on the floor inside the cavity of the ice bin;

one or more supporting connections operatively connected with the cooling device to circulate a beverage to be cooled through the cooling device;

a divider arranged within the ice holding cavity of the ice bin;

support members attached to the divider, said support members holding the divider at a desired position above the cooling device within the ice holding cavity of the ice bin; and, a plurality of perforations within the divider, said perforations being arranged such that the divider permits ice pieces to flow from a top side of the divider to a bottom side of the divider while inhibiting retrieval of ice pieces on the bottom side from the top side;

wherein the divider and support members comprise an insert which is selectively removable from the ice bin and the insert includes cutouts through which the supporting connections are routed when the insert is installed in the ice bin.

9. The beverage cooling system of claim 8, wherein the insert extends through the opening of the ice bin when installed therein.

10. The beverage cooling system of claim 8, wherein said divider includes a first section and a second section, said second section arranged at an angle relative to the first section, said angle being greater than 90 degrees and less than 180 degrees.

11. The beverage cooling system of claim 10, wherein the first section and the second section are each substantially planar.

* * * * *